US009960503B2

(12) United States Patent
Sviben

(10) Patent No.: US 9,960,503 B2
(45) Date of Patent: May 1, 2018

(54) METHOD OF STRANDED ELECTRICAL WIRE CONNECTION

(71) Applicant: Jeremy Sviben, Medford Lakes, NJ (US)

(72) Inventor: Jeremy Sviben, Medford Lakes, NJ (US)

( * ) Notice: Subject to any disclaimer, the term of this patent is extended or adjusted under 35 U.S.C. 154(b) by 299 days.

(21) Appl. No.: 15/044,157

(22) Filed: Feb. 16, 2016

(65) Prior Publication Data

US 2016/0248211 A1 Aug. 25, 2016

Related U.S. Application Data

(60) Provisional application No. 62/118,514, filed on Feb. 20, 2015.

(51) Int. Cl.
*H01R 43/00* (2006.01)
*H01R 4/70* (2006.01)
*H01R 43/05* (2006.01)

(52) U.S. Cl.
CPC ..... *H01R 4/70* (2013.01); *H01R 43/005* (2013.01); *H01R 43/05* (2013.01)

(58) Field of Classification Search
CPC ..... H01R 4/70; H01R 43/005; H01R 43/05
See application file for complete search history.

(56) References Cited

U.S. PATENT DOCUMENTS 4,354,992 A * 10/1982 Bahder ..... B29C 47/02 156/51
4,372,988 A * 2/1983 Bahder ..... H01B 7/2813 156/48
4,723,831 A * 2/1988 Johnson ..... G02B 6/4401 385/111
4,766,011 A * 8/1988 Vincent ..... H01B 3/441 427/117
4,888,886 A * 12/1989 Eager, Jr. ..... H01B 7/2813 34/104
5,125,061 A * 6/1992 Marlier ..... G02B 6/4416 174/70 R
5,200,234 A * 4/1993 Bertini ..... C08K 5/5419 427/118
5,372,840 A * 12/1994 Kleyer ..... H01B 3/441 427/117
6,162,491 A * 12/2000 Bertini ..... H01B 13/322 427/117
7,611,748 B2 * 11/2009 Bertini ..... H01B 7/285 427/117
7,615,247 B2 * 11/2009 Bertini ..... H01B 7/285 427/117
7,643,977 B2 * 1/2010 Bertini ..... G06F 17/5018 174/110 A
7,976,747 B2 * 7/2011 Bertini ..... H01B 3/20 174/25 C
8,572,842 B2 * 11/2013 Bertini ..... H01B 3/20 29/855

* cited by examiner

*Primary Examiner* — Carl Arbes
(74) *Attorney, Agent, or Firm* — Stuart M. Goldstein

(57) ABSTRACT

A method of stranded electrical wire connection involves inserting stripped, stranded ends of the wires into and then out of open container housing. A dielectric gel filled canister having an open bottom is placed over the electrical wires and the container housing, thereby completely encasing the wires. The canister is then snapped onto or otherwise secured over the container housing, to seal the electrical wires, thus completing the sealed, waterproof electrical connection.

5 Claims, 2 Drawing Sheets

METHOD OF STRANDED ELECTRICAL WIRE CONNECTION

RELATED APPLICATION

The herein application claims the benefit of provisional application Ser. No. 62/118,514 filed on Feb. 20, 2015.

BACKGROUND OF THE INVENTION

A variety of methods are currently employed for attaching lengths of stranded electrical wire. Most of these methods require that a portion of the insulation covering the end of the wire be stripped to expose the conductor strands of the wire. The exposed strands are then twisted, compressed, or otherwise manually secured together by means of a crimping tool, pliers, or even by hand. However, these methods, fundamentally, will not produce a secure, waterproof, stranded wire to stranded wire connection which will withstand stress forces which the wire connection experiences during use. Such wire connections are not secure and will eventually fail as a result of the naturally occurring conditions to which the connections are exposed.

More specifically, wires connected in this manner, when energized and then de-energized will create a heating and cooling effect, as the flow of current runs through the wires and is then turned off. This constant energizing and de-energizing of the wires causes intermittent expansion and then contraction of the wires. The endless cycle of expansion and contraction causes a constantly deteriorating effect on the wires which literally will destroy them in a relatively short period of time.

SUMMARY OF THE INVENTION

U.S. Pat. No. 8,667,676 discloses a method of stranded electrical wire connection which drastically reduces and eliminates the damaging heating and cooling effect in the connections, due to normal operation to the wires, yet caused by inconsistent tightening and crimping techniques. The method employs a ratcheting crimping tool which applies a designated, constant ratcheting compression to permanently connect stranded 8-18 gauge wires from lighting fixtures, including LED lamps, florescent lamps, and feed/power sources, by eliminating the spaces between the wire strands and thus eliminating the possibility of expansion and contraction between the strands during use. Application of the method eliminates the inconsistent and loose connections which result in ultimate untimely failure of electrical connections. The method is designed for use with stranded wire only, in low voltage, i.e. 30 volts or less, applications.

The method of the stranded electrical wire connection of the referenced '676 patent involves stripping the insulation off the ends of stranded wire, inserting a metallic barrel member over the ends of the wire, applying ratcheting pressure to the barrel member to compress the barrel member over each end of the stranded wires, and then applying constant, irreversible ratcheting pressure to the wire containing barrel to substantially eliminate the spaces between the strands and to form a permanent barrel to wire connection between the lengths of wire. A shrink tube with an inner layer of adhesive is positioned over the permanent connection and the shrink tube, with its layer of adhesive, is heated, thus substantially eliminating any space between the shrink tube and the permanent connection. Utilizing this method results in a permanent, waterproof connection between the stranded wire which eliminates all expansion and contraction within the permanent connection during use.

The method of the current invention utilizes the same crimping tool concept of the '676 patent, but instead of heat shrink sealing the connection to make it waterproof, electrical wires are crimped and threaded into and then out of an open container housing. A dielectric gel filled canister having an open bottom is placed over the electrical wires and the container housing, thereby completely encasing the wires. The canister is then snapped onto or otherwise secured over the container housing, to seal the electrical wires, thus completing the sealed, waterproof electrical connection.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

The object of the invention is to provide a method which permanently connects lengths of stranded electrical wire in order to eliminate any possibility of expansion and contraction between the strands of the wire, thereby ensuring the longevity and waterproofing of the connection.

Figure 1:
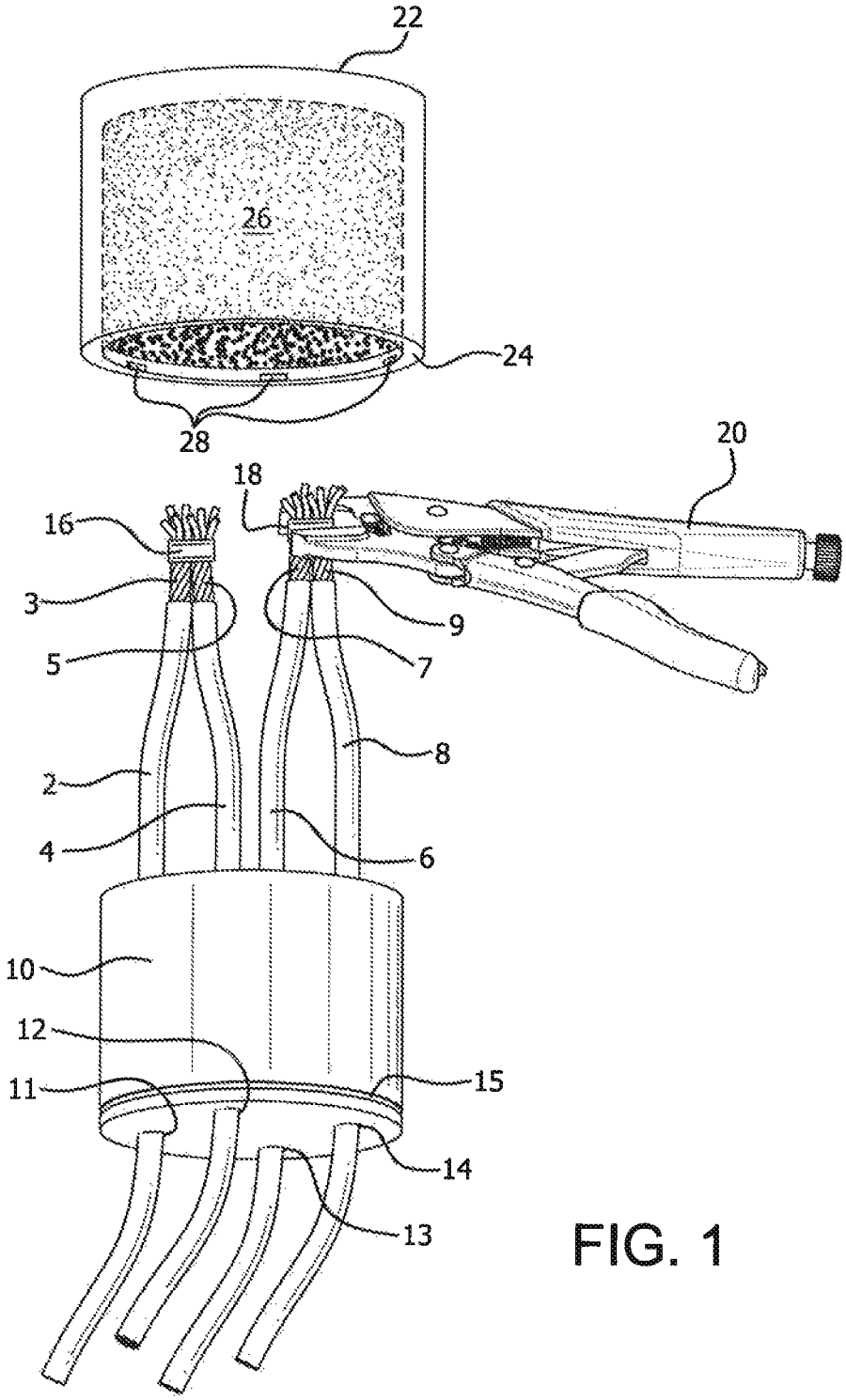
FIG. 1 shows four stranded electrical wires, to be connected in accordance with the method of the present invention, the wires extending through a housing container, and with a gel filled canister in position over the housing container.

As seen in FIG. 1, the ends of stranded electrical wires 2, 4, 6, and 8 are first stripped of their insulation. The wires are then threaded through openings 11, 12, 13, and 14 at the bottom of container housing 10 such that they extend through and out of the container housing, which is opened at its top end. Wires 2 and 4 and wires 6 and 8 are positioned together, with their respective exposed electrical conductor strands 3 and 5 and strands 7 and 9 pressed together and intermeshed.

Strands 3 and 5 and strands 7 and 9 are next securely connected by ratcheting pressure. In this instance, FIG. 1 shows the use of metallic compression members, such as halo rings 16 and 18, positioned around the strands to secure them together. Ratcheting crimper tool 20 is utilized to provide constant, irreversible ratcheting pressure to tightly compress halo rings 16 and 18, and thus strands 3 and 5 and strands 7 and 9, therebetween. Ratcheting pressure, accomplished in distinct, irreversible ratcheting intervals, tightly compresses the strands of the wire such that the spaces between the strands and the compression member are substantially eliminated. A ratcheting crimper tool is used, since once the crimping process begins, this tool provides a constant pressure which will not reverse until the connection has been fully compressed or the tool's release button is pushed. This creates a consistent, increasingly tight, compressed wire connection regardless of the strength of the installer.

After halo rings 16 and 18 and strands 3 and 5 and strands 7 and 9 have been compressed, wires 2 and 4 are withdrawn, such that the compressed halo rings and ends of the wires are entirely located within container housing 10. See FIG. 2.

Figure 2:
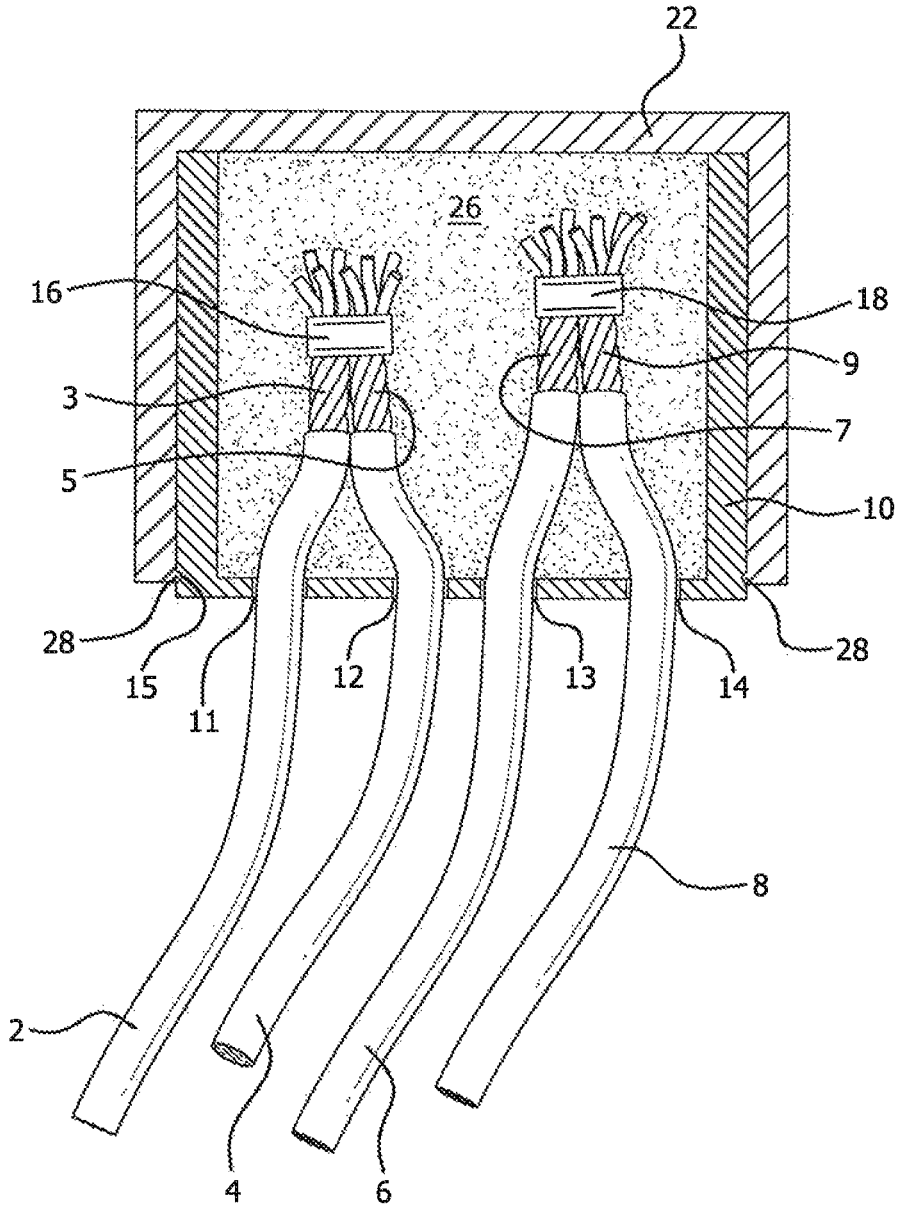
FIG. 2 is a partial cross-section showing the dielectric gel filled canister encasing the housing container and stranded electrical wires, in accordance with the method of the present invention.

Canister 22, open at its bottom end 24, is filled with dielectric gel 26. As seen in FIG. 1, the canister's open bottom end 24 is positioned in spaced relation to and over container housing 10 and then inserted onto and completely over the container housing. When canister 22 fully encloses container housing 10, the canister is then secured in this position over the container housing, as seen in FIG. 2, by means of tabs 28 extending from the canister which are snapped onto slotted rim 15 encircling the container housing, or equivalent securing means. This completely encases strands 3, 5, 7, and 9, sealing the strands within dielectric gel 26. A permanent waterproof electrical wire connection has thereby been ensured.

It is contemplated that the method of the present invention can be used to connect 8-20 gauge stranded electrical wires which come from, lighting fixtures, LED lamps, florescent lamps, and other feed power sources. However, wire of different gauges can successfully be used with this method. The type and size of the wires described herein should not be considered restrictive to the method of the invention. The herein method is directed for use with stranded wire only, for low voltage, i.e., 600 volts or less, applications.

Application of this method will result in electrical connections which can be buried in soil types ranging from acid to alkali. The connections which are made are especially important for use in the connection of current/voltage sensitive lighting sources such as LED lamps and low voltage lighting fixtures.

Certain novel features and components of this invention are disclosed in detail in order to make the invention ear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. The method of insulated stranded electrical wire connection comprising the steps of:

providing separate lengths of stranded electrical wire to be connected;

stripping insulation of the ends of each of said lengths of wire to expose conductor strands;

providing a container housing having an open top and bottom openings;

threading the lengths of electrical wire through the bottom openings of the housing container;

pressing the exposed conductor strands together so that the strands are intermeshed;

providing a compression member;

inserting the compression member over the pressed, intermeshed conductor strands;

applying constant pressure to the compression member in distinct, irreversible, ratcheting pressure intervals to tightly compress the exposed conductor strands of each length of wire within compression member;

continuing to apply constant pressure to the compression member in distinct, irreversible, ratcheting pressure intervals until all spaces between the conductor strands and the compression member are eliminated, forming a secure connection between said lengths of wire with no spaces between the conductor strands and the compression member;

withdrawing the lengths of electrical wire into the container housing, such that the compression member and compressed conductor strands are located with the container housing;

providing a canister with an open bottom, the canister containing a dielectric gel;

inserting the dielectric gel filled canister onto and completely over the container housing, such that the conductor strands and compression member are completely encased and sealed within the dielectric gel; and securing the canister over the container housing to provide a permanent, watertight connection between the lengths of wire.

2. The method as in claim 1 further comprising the step of providing a ratcheting crimping tool to apply the constant pressure.

3. The method as in claim 1 wherein in applying constant pressure the compression member and exposed conductor strands are subjected to increasingly tightened, irreversible compression.

4. The method as in claim 1 wherein the compression member comprises a halo ring.

5. The method as in claim 1 wherein the step of securing the canister over the container housing comprises snapping tabs on the canister into a slotted rim on the container housing.

* * * * *